US008798896B2

(12) United States Patent
Srinivasan et al.

(10) Patent No.: US 8,798,896 B2
(45) Date of Patent: Aug. 5, 2014

(54) RELIABILITY OF TRAVEL TIME ESTIMATION

(75) Inventors: Vikram Srinivasan, Ferns (IN); Avhishek Chatterjee, Ferns (IN); Samik Datta, Karnataka (IN); Supratim Deb, Somerset, NJ (US); Sharad Jaiswal, Karnataka (IN)

(73) Assignee: Alcatel Lucent, Boulogne-Billancourt (FR)

( * ) Notice: Subject to any disclaimer, the term of this patent is extended or adjusted under 35 U.S.C. 154(b) by 211 days.

(21) Appl. No.: 13/498,178

(22) PCT Filed: Oct. 27, 2009

(86) PCT No.: PCT/IB2009/055234

§ 371 (c)(1), (2), (4) Date: Jun. 19, 2012

(87) PCT Pub. No.: WO2011/051758

PCT Pub. Date: May 5, 2011

(65) Prior Publication Data

US 2012/0253647 A1 Oct. 4, 2012

(51) Int. Cl.
*G08G 1/00* (2006.01)

(52) U.S. Cl.
USPC ..... 701/117; 348/61

(58) Field of Classification Search
USPC ..... 701/117–119, 23, 25; 340/907, 910, 340/915, 919, 934; 348/61, 149
See application file for complete search history.

(56) References Cited

U.S. PATENT DOCUMENTS

| | | | | |
|---|---|---|---|---|
| 6,542,808 | B2 * | 4/2003 | Mintz | 701/117 |
| 8,068,973 | B2 * | 11/2011 | Yamane et al. | 701/117 |
| 2005/0093720 | A1 | 5/2005 | Yamane et al. | |

FOREIGN PATENT DOCUMENTS

| | | |
|---|---|---|
| EP | 2040237 | 3/2009 |
| GB | 2424111 | 9/2006 |
| WO | 9411839 | 5/1994 |

* cited by examiner

*Primary Examiner* — Dalena Tran
(74) *Attorney, Agent, or Firm* — Carmen Patti Law Group, LLC

(57) ABSTRACT

A method and system for increasing accuracy in estimating average time taken to travel through a chosen road segment is provided. The method includes determination of time taken by one or more vehicles to travel through the road segments. Further, correlated road segments for which time taken to travel through the correlated road segments is correlated with the time taken to travel through the chosen road segment, are identified. A data repository stores a list of the one or more correlated road segments. Among the correlated road segments, one or more preferred road segments that increases the accuracy in determining the average time taken to travel through the chosen road segment, is determined by at least one processor. Further, the processor estimates the average time taken to travel through the chosen road segment using, data corresponding to time taken to travel through, the preferred road segments and the chosen road segment.

5 Claims, 6 Drawing Sheets

RELIABILITY OF TRAVEL TIME ESTIMATION

FIELD OF INVENTION

This invention relates to road traffic management and, more particularly but not exclusively, to improving travel time estimates.

BACKGROUND

In road traffic management, time taken to travel road segments is determined, and the same is used for various purposes. One such purpose is prediction of time that may be taken to travel a segment at a future time point. Currently various techniques have been provided to determine time taken to travel one or more road segments. Some of the techniques relate to systems and methods using vehicles with GPS-based devices as probes, cellular triangulation based solutions, and near field communication devices in vehicles, among others.

In estimating travel times, number of samples of travel times which are available for a road segment could be insufficient to compute a statistically accurate estimate of quantities such as average travel time, and standard deviation, among others.

In an existing technique using near field communication devices, near field communication device sensors network is deployed in a city. To determine travel times between two points "A" and "B", near field communication sensor-A and sensor-B which are deployed at points "A" and "B" are used. Each of the sensors detects vehicles that have a near field communication device in them. When a vehicle V passes by the vicinity of sensor-A, sensor-A communicates with the near field communication device in the vehicle V and detects the identity of the near field communication device in vehicle V and notes the time at which the vehicle V passes sensor-A. Subsequently, further down on the same road stretch, when the vehicle passes sensor-B, the sensor notes down the identity of the near field communication device in vehicle V and the time at which it passes B. Sensors A and B communicate this information to a central server. The central server then computes the travel time of vehicle V from A to B. If a sufficient number of vehicles are detected on the road stretch from A to B, then a statistically accurate estimate of quantities such as, average time to travel on road stretch from A to B and standard deviation in the travel time, among others, can be computed more accurately. However the sensors may not detect every detectable vehicle because, the wireless medium could be lossy, especially because near field communication mostly happens over unlicensed ISM band and, many near field communication devices like Bluetooth go through sleep and awake cycle in passive mode. Hence, there is always a probability that a near-field communication device is in sleep mode for the entire duration of proximity to a sensor. Therefore the number of vehicles commonly detected by two sensors on a road stretch could be insufficient to compute a statistically accurate estimate of quantities such as the average travel time, the standard deviation etc.

This section introduces aspects that may be helpful in facilitating a better understanding of the invention. Accordingly, the statements of this section are to be read in this light and are not to be understood as admissions about what is in the prior art or what is not in the prior art.

SUMMARY

An embodiment provides method for increasing accuracy in estimating average time taken to travel through a chosen road segment. The method includes collecting data corresponding to one or more vehicles travelling through road segments, thereby enabling determination of time taken by one or more vehicles to travel through the road segments. Further, one or more correlated road segments for which time taken to travel through the correlated road segments is correlated with the time taken to travel through the chosen road segment, are identified. A data repository stores a list of the one or more correlated road segments. Among the correlated road segments, one or more preferred road segments that increases the accuracy in determining the average time taken to travel through the chosen road segment, is determined by at least one processor. Further, the processor estimates the average time taken to travel through the chosen road segment using, data corresponding to time taken to travel through, the preferred road segments and the chosen road segment.

Another embodiment provides a method for increasing accuracy in estimating average time taken to travel through a chosen road segment. The method includes collecting data corresponding to one or more vehicles travelling through road segments, thereby enabling determination of time taken by one or more vehicles to travel through the road segments. Further, one or more correlated road segments for which time taken to travel through the correlated road segments is correlated with the time taken to travel through the chosen road segment, are identified. A data repository stores a list of the one or more correlated road segments. Further, for each of the correlated road segments, correlation between the time taken to travel through correlated road segments with the time taken to travel through the chosen road segment is determined by at least one processor using historical data corresponding to time taken to travel through, each of the correlated road segments and the chosen road segment. Further, the processor computes average time taken to travel through each of the correlated road segments. Subsequently, the processor estimates average time taken to travel through the chosen road segment, using the average time taken to travel through each of the correlated road segments and correlation between the time taken to travel through each of the correlated road segments with the time taken to travel through the chosen road segment.

Another embodiment provides a system for increasing accuracy in estimating average time taken to travel through a chosen road segment. The system includes a road traffic sensing system, at least one data repository and at least one processor. The road traffic sensing system is configured to collect data corresponding to one or more vehicles travelling through road segments, thereby enabling determination of time taken by one or more vehicles to travel through the road segments. The data repository is configured to store historical data corresponding to time taken to travel through the road segments, which is determined by the data collected by the road traffic sensing system. Further, the data repository stores a list of one or more correlated road segments for which time taken to travel through the correlated road segments is correlated with the time taken to travel through the chosen road segment. The processor is configured to determine time taken by one or more vehicles to travel through the road segments using the data, collected by the road traffic sensing system, corresponding to one or more vehicles travelling through road segments. Additionally, the processor identifies the one or more correlated road segments for which the time taken to travel through the correlated road segments is correlated with the time taken to travel through the chosen road segment. Among the correlated road segments, one or more preferred road segments that increase the accuracy in determining average time taken to travel through the chosen road segment are identified by the processor. Further, the processor determines the average time taken to travel through the chosen road segment using, data corresponding to time taken to travel through, the preferred road segments and the chosen road segment.

Another embodiment provides a system for increasing accuracy in estimating average time taken to travel through a chosen road segment. The system includes a road traffic sensing system, at least one data repository and at least one processor. The road traffic sensing system is configured to collect data corresponding to one or more vehicles travelling through road segments, thereby enabling determination of time taken by one or more vehicles to travel through the road segments. The data repository is configured to store historical data corresponding to time taken to travel through the road segments, which is determined by the data collected by the road traffic sensing system. Additionally, the data repository is configured to store a list of one or more correlated road segments for which time taken to travel through the correlated road segments is correlated with the time taken to travel through the chosen road segment. The processor is configured to determine time taken by one or more vehicles to travel through the road segments using the data, collected by the road traffic sensing system, corresponding to one or more vehicles travelling through road segments. Further, the processor identifies one or more correlated road segments for which time taken to travel through the correlated road segments is correlated with the time taken to travel through the chosen road segment. Additionally, the processor determines correlation between the time taken to travel through each of the correlated road segments with the time taken to travel through the chosen road segment using the historical data, stored in the data repository, corresponding to time taken to travel through, the correlated road segments and the chosen road segment. The processor further determines average time taken to travel through each of the correlated road segments. Subsequently, the processor estimates average time taken to travel through the chosen road segment using the average time taken to travel through each of the correlated road segments and correlation between the time taken to travel through each of the correlated road segments with the time taken to travel through the chosen road segment.

These and other aspects of the embodiments herein will be better appreciated and understood when considered in conjunction with the following description and the accompanying drawings.

BRIEF DESCRIPTION OF THE FIGURES

Some embodiments of apparatus and/or methods in accordance with embodiments of the present invention are now described, by way of example only, and with reference to the accompanying drawings, in which.

DESCRIPTION OF EMBODIMENTS

Figure 1:
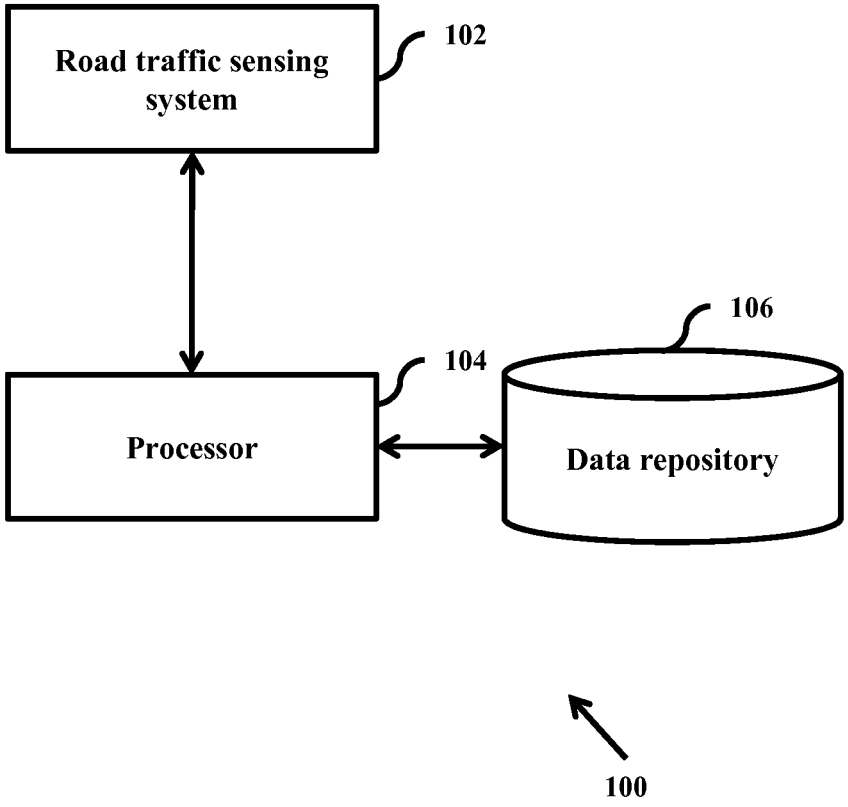
FIG. 1 is a block diagram illustrating a system for increasing accuracy in estimating average time taken to travel through a chosen road segment, in accordance with an embodiment.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein achieve a method for adaptively increasing accuracy in estimating average time taken to travel through a chosen road segment. Referring now to the drawings, and more particularly to FIGS. 1 through 5, where similar reference characters denote corresponding features consistently throughout the figures, there are shown embodiments.

In road traffic management statistical data is used for various purposes such as, planning of road infrastructure and prediction of travel time, among others. To enable providing statically data with substantial reliability, a reasonable amount of travel related data is desired.

Embodiments provide a system and method for increasing accuracy in providing statistics related to time taken to travel through a chosen road segment. In an embodiment, a system for increasing accuracy in estimating average time taken to travel through a chosen road segment is provided. FIG. 1 is a block diagram illustrating a system 100 for increasing accuracy in estimating average time taken to travel through a chosen road segment, in accordance with an embodiment. The system 100 comprises a road traffic sensing system 102, at least one processor 104 and at least one data repository 106. The road traffic sensing system 102 is configured to collect data corresponding to one or more vehicles travelling through road segments, thereby enabling determination of time taken by one or more vehicles to travel through the road segments. The data collected by the road traffic sensing system 102 is used by the processor 104 to determine time taken to travel by the vehicles through the road segments. Historical data corresponding to time taken to travel by vehicles through the road segments, over a period of time, is stored in the data repository 106. The processor 104 uses the data collected from the road traffic sensing system 102 and data stored in the data repository 106 to increase accuracy in estimating an average time taken to travel through the chosen road segment. Various types of road traffic sensing system 102 can be used to collect data corresponding to one or more vehicles travelling through road segments. One such road traffic sensing system 102 uses cellular communication or Global Positioning System (GPS) devices to detect location estimates of vehicles. The GPS devices are usually carried within the vehicles. The speed of the vehicle can then be obtained from the GPS location data provided by the GPS devices at different points at different times. Another such road traffic sensing system 102 uses near field communication device scanners to collect data corresponding to one or more vehicles travelling through road segments.

Figure 2:
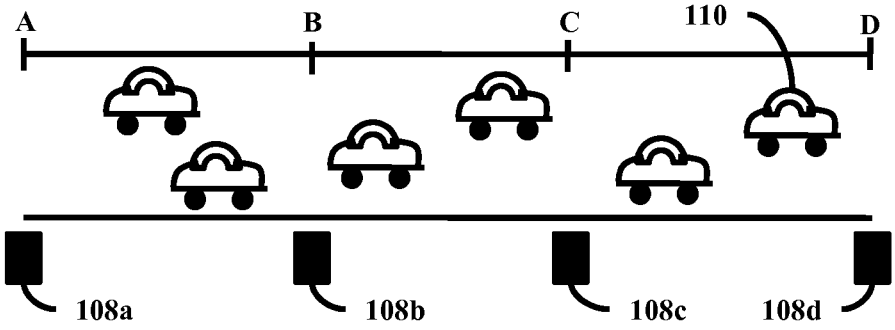
FIG. 2 illustrates a road stretch, in accordance with an embodiment.

FIG. 2 is an illustration of a road traffic sensing system 102, in accordance with an embodiment. A plurality of scanning devices 108*a*, 108*b*, 108*c* and 108*d* are placed along a road stretch AD. The scanning devices 108 can detect near field communication devices present in the vehicles 110, which are using Bluetooth, ZigBee, Wi-Fi, Radio frequency Identification (RFID) or any other form of near field communication. The scanning devices 108 can detect vehicles 110 carrying devices capable of near field communication and note down a unique ID of the device and the time of detection of the vehicles. As an example, the scanning devices 108 detect vehicles with Bluetooth devices and note a unique Bluetooth ID of the device. The information is then transmitted periodically to the processor 104 over a wireless data link. The processor 104 aggregates the data from different sensors, cleans the data and writes the data into the data repository 106. The processor 104 accesses the data from the data repository 106 and computes the travel time estimate between two successive sensors 108.

Figure 3:
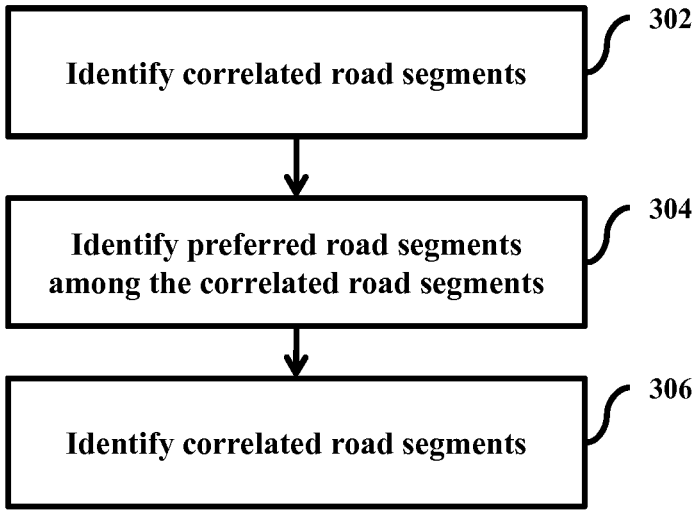
FIG. 3 is a flowchart illustrating a method for increasing accuracy in estimating average time taken to travel through a chosen road segment, in accordance with an embodiment.

In an embodiment, accuracy in estimating average time taken to travel through the chosen road segment is increased in accordance with a flowchart illustrated in FIG. 3. In accordance to FIG. 3, at step 302, one or more correlated road segments for which time taken to travel through the correlated road segments is correlated with the time taken to travel through the chosen road segment, is identified. A list of the correlated road segments corresponding to the chosen road segment can be determined by the processor 104, and the list can be stored in the data repository 106. In an embodiment, the correlated road segments are road segments in which vehicles travelling through the chosen road segment most likely also travel through the correlated road segments. The road stretch AD in FIG. 2 comprises of three road segments, namely, AB, BC and CD. If BC is the chosen road segment, then road segments AB and CD may be considered as correlated road segments. As seen in the figure, it is clear that vehicles that pass through the chosen road segment BC would most likely pass through the correlated road segments AB and CD. Further, the time taken to travel through the road segments AB and CD would be correlated with the time taken to travel through the chosen road segment BC. Hence, in an embodiment, road segments that are consecutive to the chosen road segments are chosen are correlated road segment. Further, in an embodiment, road segments through which vehicles that travel through the chosen road segment, also pass through, are selected as the correlated road segments. It may be noted that the primary intention is to choose road segments whose travel times have correlation with the travel times of the chosen road segment, as correlated road segments.

In an embodiment, historical data, which is stored in the data repository 106, corresponding to the time taken to travel through, a correlated road segment and the chosen road segment, is used by the processor 104 to determine the correlation between the correlated road segment and the chosen road segment. After determining the correlation, the same can be stored by in the data repository. In an embodiment, the travel times of the correlated road segments have linear or near linear correlation with the travel times of the chosen road segment. For example, if a vehicle "i" takes X(i) seconds and Y(i) seconds to travel through, a correlated road segment and chosen road segment, respectively, then the travel times are linearly related in accordance with the below equation:

$$Y(i)=aX(i)+b$$

In the above equation, "a" and "b" are constants of the equation.

The constants "a" and "b" are determined using historical data corresponding to travel times of the correlated road segment and the chosen road segment.

In an embodiment, "a" and "b" are determined based on the time interval of travel at which the travel time relationship is desired.

In an embodiment, "a" and "b" are determined based on the amount of time taken to travel through at least one of, correlated road segment and chosen segment.

In an embodiment, the travel time relationship between the travel times of the correlated road segment and the chosen road segment may not be linear or near linear. Alternatively, the correlation is such that, travel times of the chosen road segment is a function of travel times of the correlated road segment. Such a correlation between the correlated road segment and the chosen road segment can be expressed by the below equation:

$$Y(i)=f(X(i)),\text{where } Y(i) \text{ is a function of } X(i)$$

The chosen road segment, based on the road layout, may have one or more correlated road segments. Subsequent to determination of correlated road segments for a chosen road segment, the processor 104 identifies one or more preferred road segments among the correlated road segments, in accordance with step 304 in FIG. 3. The travel time data relating to the preferred road segments increases the accuracy in determination of the statistics related to time taken to travel through the chosen road segment.

Figure 4A:
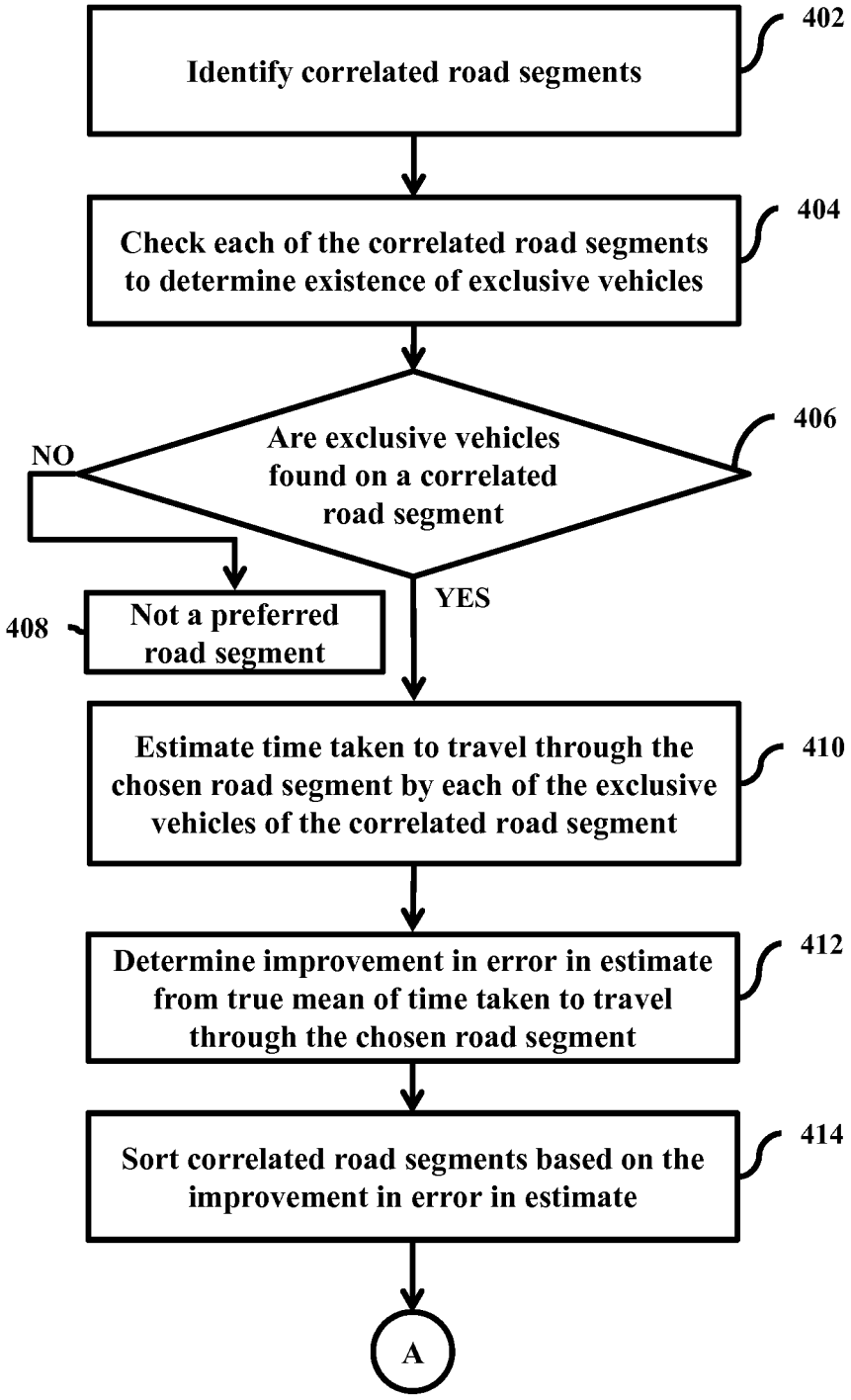
FIGS. 4*a* and 4*b* are flowcharts illustrating a method for identifying one or more preferred road segments among the correlated road segments, in accordance with an embodiment.
Figure 4B:
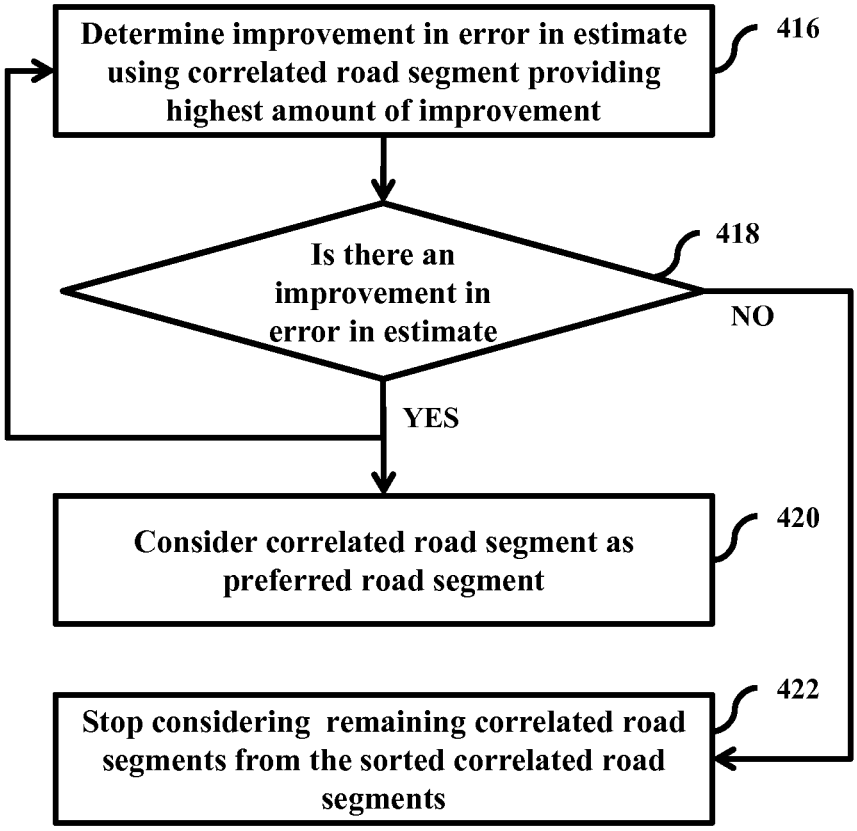

FIGS. 4*a* and 4*b* are flowcharts illustrating a method for identifying one or more preferred road segments among the correlated road segments, in accordance with an embodiment. The correlated road segments corresponding to the chosen road segment are considered to identify one or more preferred road segments among the correlated road segments that can be used to increase the accuracy in determination of the statistics related to time taken to travel the chosen road segment. Further, at step 404, the processor 104 analyzes each of the correlated road segments to determine if there are any vehicles for which time taken to travel is available only for the correlated road segment and not available for the chosen road segment. These vehicles for which time taken to travel is available only for the correlated road segment and not available for the chosen road segment are termed as exclusive vehicles. At step 406 and 408, correlated road segments which do not comprise exclusive vehicles are filtered out by the processor 104 as non preferred road segments, whereas, correlated road segments which comprise exclusive vehicles are further considered to determine if they are preferred road segments. Subsequently, the processor 104 at step 410 and 412, analyzes the correlated road segments with exclusive vehicles to determine the amount of improvement each of the correlated road segments with exclusive vehicles would provide to the error in estimate from true mean of travel time of chosen road segment. In an embodiment, to determine the amount of improvement, the time taken to travel through a correlated road by each of the exclusive vehicles of the correlated road is considered. The time taken to travel through the correlated road by each of the exclusive vehicles of the correlated road is used to estimate the time taken by each of the exclusive vehicles through the chosen segment. The estimate of the time taken on the chosen road is based on the correlation between the chosen road segment and the correlated segment under consideration. For example, if "N" is the number of exclusive vehicles, "X(i)" is the time taken by each of the exclusive vehicles to travel through the correlated road segment, where, $1 \le i \le N$, and "$Y^1(i)$" is the estimate of time taken by each of the N exclusive vehicles, than the (i) is derived using the below equation:

$$Y^1(i)=aX(i)+b$$

In the above equation, the correlated road segment is linearly correlated with the chosen road segment.

Alternatively, if the correlated road segment is correlated with the chosen road segment in such a way that time taken to travel through the chosen road segment is a function of time taken to travel through the correlated road segment, then $Y^1(i)$ is derived by the processor 104 using the below equation:

$$Y^1(i)=f(X(i))$$

The estimate $Y^1(i)$ of time taken by each of the N exclusive vehicles to travel through the chosen road segment is used to determine variance $\sigma(Y^1)^2$ of the estimate. The variance $\sigma(Y^1)^2$ of the estimate is used to determine the improvement in error in estimate.

In an embodiment, a correlated road provides an improvement in error in estimate if the below equation is true:

$$\frac{N}{M}+2>\frac{\sigma(Y^1)Z}{\sigma(Y)Z}$$

Where M is the number of vehicles for which time taken to travel through the chosen road segment is available, and $\sigma(Y)$ is the true variance of time taken to travel through the chosen road segment. In an embodiment, the true variance is determined from historical data. For example, for determining true variance at 9 a.m., historical data corresponding to 9 a.m. traffic is used.

Further, the processor 104 at step 414, sorts the correlated road segments based on the improvement provided by each of the correlated road segments comprising exclusive vehicles. Subsequently, the processor 104 at step 416, uses travel time data corresponding to a correlated road segment that provides the highest improvement in error in estimate to determine the improvement in error in estimate. If there is an improvement, than that correlated road segment is considered as a preferred road segment. Further, a correlated road segment that provides the next best improvement is used by the processor 104 to determine if there is a further improvement in error in estimate. If there is improvement, then even this correlated road segment is considered as a preferred road segment by the processor 104. This process of considering sorted correlated road segments continues till considering a correlated road segment results in providing no improvement in error in estimate. Further, all the correlated road segments that result in improvement in error in estimate are considered as preferred road segments.

The travel times of exclusive vehicles corresponding to the preferred road segments are used to compute average time taken to travel the chosen road segment, thereby increasing accuracy in determining the statistics related to the time taken to travel the chosen road segment, in accordance with step 306 of FIG. 3.

For example, for a chosen road segment comprising a single preferred road segment, statistics such as average travel time to travel through the chosen road segment is estimated using the below equation:

$$\mu^1=\left(\sum_{i=1}^{M}Y(i)+\sum_{j=1}^{N}Y(j)^1\right)\Big/(M+N)$$

Where, $\mu^1$ is an estimate of average travel time to travel through the chosen road segment M is the number of vehicles for which time taken to travel through the chosen road segment is available N is the exclusive number of vehicles corresponding to the preferred road segment Y(i) is the time taken to travel through the chosen road segment by each of the M vehicles $Y(j)^1$ is the time taken to travel through the chosen road segment by each of the N exclusive vehicles estimated using the correlation between the preferred road segment and the chosen road segment.

In an embodiment, $Y(j)^1$ is derived using the below equation:

$$Y(j)^1=aX(j)+b, 1\leq j\leq N$$

Where,

X(j) is the time taken to travel by the $J^{th}$ exclusive vehicle through the preferred road.

It may be noted that based on the correlation between the preferred road segment and the chosen road segment, the equation used to determine $Y(j)^1$ will vary.

Further, it may be noted that, based on the number of preferred road segments, the equation for determining $\mu^1$ will vary.

Figure 5:
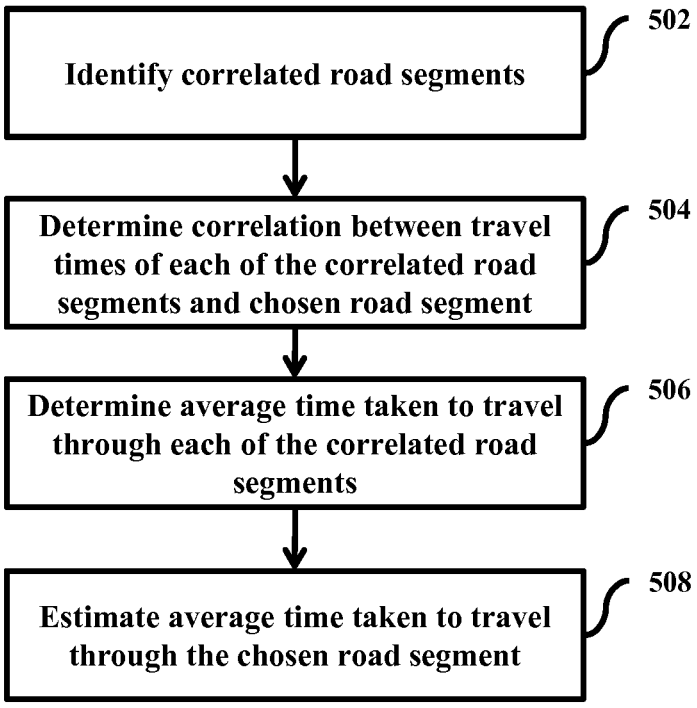
FIG. 5 is a flowchart illustrating a method for increasing accuracy in determining statistics related to time taken to travel through a chosen road segment, in accordance with an embodiment.

In an embodiment, accuracy in estimating average time taken to travel through a chosen road segment is increased, in accordance with a flowchart illustrated in FIG. 5. In accordance with the flowchart, the processor 104 at step 502, identifies one or more road segments (correlated road segments) whose travel times are correlated with the travel times of the chosen road segments. After identifying the correlated road segments, a list of correlated road segments may be stored in the data repository 106. In an embodiment, road segments which have an impact on traffic status or travel times of the chosen road segment are selected as the correlated road segment. The correlated road segments can be chosen by using historical travel time data, stored in the data repository, of the chosen road segment and road segments which have the potential of being correlated road segment. Further, the processor at step 504, determines for each of the correlated road segment, the correlation between the travel times of the correlated road segment and chosen road segment is determined. The processor 104 determines the correlation using data corresponding to time taken to travel through the correlated road segment and the chosen road segment, which is stored in the data repository 106. The correlation is such that the average travel time for the chosen road segment is a function of the average travel time of the correlated road segment. The correlation function could be a linear function or a non linear function. Further, it may be noted that the correlation between the travel times of the correlated road segment and the chosen road segment may vary based on one or more of, the time interval of travel and traffic status, among others. Further, at step 506, average time taken to travel through each of the correlated road segments is determined. At step 508, the average time taken to taken to travel through each of the correlated road segments and correlation between each of the correlated road segments and the chosen road segments is used to determine statistics such as average time taken to travel through the chosen road segment.

Example

Take an example of three road segments, link1, link2 and link3. We may further consider that that E[X_1]=f(E[X_2], E[X_3]). In practice, one does not know f( ) and hence, has to be numerically found based on historical data. For a city road this function may also be changing with time of day, but due to the cyclo-stationary nature of the city traffic, f( ) will be same at a particular time on every day. To obtain f( ) say at 9:00 a.m., we collect all archived E[X_i] at 9:00 a.m. and carry out a regression to find the function closest to f( ) and call it f( ). As we can not get an exact f( ) there is an error associated with approximating it and let us call it e_f (this can be measured from the regression). Now to get a reliable estimate of E[X_1] at current time we first calculate a sample mean by taking average of the travel time found on the link1. Associated to sample mean we also get a sample variance that gives the confidence on that sample mean. If this variance is less than e_f we use this as E[X_1], otherwise we use \hat{f}(E[X_2],E[X_3]).

In an embodiment, a chosen road segment has "V" number of correlated road segments. Each of the V correlated road segments is correlated to the chosen road segment in such a way that the average travel time for the chosen road segment is a function of average travel time of the correlated road segment. The correlation of first of the V correlated road segments can be defined using the below equation:

$$E(Y)=f_1(E(X_1))$$

Where,

E(Y)—Average travel time for chosen road segment $E(X_1)$—Average travel time for $1^{st}$ of the correlated road segment Further, the above expression can be generalized as given below:

$$E(Y)=f_i(E(X_i)),1\leq i\leq V$$

Further, based on the above equation, average travel time for the chosen road segment can be derived using the below equation:

$$E(Y)^1=\sum_{i=1}^{V}\frac{f_i(E(X_i))}{V}$$

Where, $E(Y)^1$ is the estimated average travel time for the chosen road segment.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The functions of the various elements shown in the FIG. 1, including any functional blocks labeled as "processor", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the FIGS. are conceptual only. Their function may be carried out through the operation of program logic, through dedicated logic, through the interaction of program control and dedicated logic, or even manually, the particular technique being selectable by the implementer as more specifically understood from the context.

It should it will be appreciated that any flow charts, flow diagrams, pseudo code, and the like represent various processes which may be substantially represented in computer readable medium and so executed by a computer or processor, whether or not such computer or processor is explicitly shown.

What is claimed is:

1. A method for increasing accuracy in estimating an average time taken to travel through a chosen road segment, the method comprising:

a road traffic sensing system collecting data corresponding to one or more vehicles travelling through road segments, thereby enabling determination of a time taken by the one or more vehicles to travel through the road segments;

at least one processor identifying one or more correlated road segments for which the time taken to travel through the correlated road segments is correlated with the time taken to travel through the chosen road segment, the processor identifying one or more preferred road segments among the correlated road segments that increases the accuracy in determining the average time taken to travel through the chosen road segment; and the processor estimating the average time taken to travel through the chosen road segment using data corresponding to a time taken to travel through the preferred road segments and using data corresponding to the time taken to travel through the chosen road segment, characterized in that identifying the preferred road segments comprises:

identifying the correlated road segments which comprise exclusive vehicles for which the time taken to travel is known for the correlated road segments and for which the time taken to travel is not known for the chosen road segment;

estimating the time taken to travel by each of the exclusive vehicles on the chosen road segment using the correlation between the correlated road segments and the chosen road segment;

determining, for each of the correlated road segments, an improvement that is achieved in estimating the average travel time by using data corresponding to an estimated time taken to travel by each of the exclusive vehicles on the chosen road segment;

sorting the correlated road segments based on the improvement achieved in estimating the average travel time; and determining a reduction in error in estimating the average time taken to travel through the chosen road segment by using the time taken by exclusive vehicles, by considering the correlated road segments in decreasing order of reduction in error, till one of the correlated road segments does not reduce the error in the estimate compared to the reduction in error by the previous correlated road segment which provided the reduction in error, wherein the correlated road segments which provided the reduction in error in estimate are considered as preferred road segments wherein estimating the time taken to travel by each of the exclusive vehicles on the chosen road segment using the correlation between the correlated road segments and the chosen road segment is derived using the equation:

$$Y(j)^1 = f(X(j)), 1 \leq j \leq N,$$

wherein N is the number of exclusive vehicles corresponding to one of the correlated road segments, X(j) is the time taken to travel by the $J^{th}$ exclusive vehicle through the one of the correlated road segments, $Y(j)^1$ is the estimated time taken to travel through the chosen road segment by each of the $J^{th}$ exclusive vehicles, and f is a function.

2. The method according to claim 1, wherein the function f varies based on at least one of a time interval of travel through the one of the correlated road segments and a traffic status of the one of the correlated road segments.

3. A method for increasing accuracy in estimating an average time taken to travel through a chosen road segment, the method comprising:

a road traffic sensing system collecting data corresponding to one or more vehicles travelling through road segments, thereby enabling determination of a time taken by the one or more vehicles to travel through the road segments;

at least one processor identifying one or more correlated road segments for which the time taken to travel through the correlated road segments is correlated with the time taken to travel through the chosen road segment, the processor identifying one or more preferred road segments among the correlated road segments that increases the accuracy in determining the average time taken to travel through the chosen road segment; and the processor estimating the average time taken to travel through the chosen road segment using data corresponding to time taken to travel through the preferred road segments and the time taken to travel through the chosen road segment, characterized in that identifying the preferred road segments comprises:

identifying the correlated road segments which comprise exclusive vehicles for which the time taken to travel is known for the correlated road segments and for which the time taken to travel is not known for the chosen road segment;

estimating the time taken to travel by each of the exclusive vehicles on the chosen road segment using the correlation between the correlated road segments and the chosen road segment;

determining, for each of the correlated road segments, an improvement that is achieved in estimating the average travel time by using data corresponding to an estimated time taken to travel by each of the exclusive vehicles on the chosen road segment;

sorting the correlated road segments based on the improvement achieved in estimating the average travel time; and determining a reduction in error in estimating the average time taken to travel through the chosen road segment by using the time taken by exclusive vehicles, by considering the correlated road segments in decreasing order of reduction in error, till one of the correlated road segments does not reduce the error in the estimate compared to the reduction in error by the previous correlated road segment which provided the reduction in error, wherein the correlated road segments which provided the reduction in error in estimate are considered as preferred road segments wherein, determining the statistics related to the time taken to travel the chosen road segment comprises, estimating average time taken to travel through the chosen road segment using the equation:

$$\mu^1 = \left( \sum_{i=1}^{M} Y(i) + \sum_{j=1}^{N} Y(j)^1 \right) \Big/ (M + N)$$

wherein $\mu^1$ is an estimate of the average travel time to travel through the chosen road segments, M is the number of vehicles for which the time taken to travel through the chosen road segments is available, N is the exclusive number of vehicles corresponding to the preferred road segment, Y(i) is the time taken to travel through the chosen road segment by each of the M vehicles, and $Y(j)^1$ is the time taken to travel through the chosen road segment by each of the N exclusive vehicles, estimated using the correlation between the preferred road segment and the chosen road segment.

4. A system for increasing accuracy in estimating an average time taken to travel through a chosen road segment, the system comprising:

a road traffic sensing system configured to collect data corresponding to one or more vehicles travelling through road segments, thereby enabling determination of a time taken by the one or more vehicles to travel through the road segments;

at least one data repository configured to:

store a list of one or more correlated road segments for which the time taken to travel through the correlated road segments is correlated with the time taken to travel through the chosen road segment; and store historical data corresponding to the time taken to travel through the road segments; and at least one processor configured to:

determine the time taken by the one or more vehicles to travel through the road segments using the data collected by the road traffic sensing system, corresponding to one or more vehicles travelling through road segments;

identify the one or more correlated road segments for which the time taken to travel through the correlated road segments is correlated with the time taken to travel through the chosen road segment;

identify one or more preferred road segments among the correlated road segments that increases the accuracy in determining average time taken to travel through the chosen road segment; and determine the average time taken to travel through the chosen road segment using data corresponding to the time taken to travel through the preferred road segments and using data corresponding to the time taken to travel through the chosen road segment, characterized in that the processor is configured to:

identify the correlated road segments which comprise exclusive vehicles for which time taken to travel is known for the correlated road segments and not known for the chosen road segment;

estimate time taken to travel by each of the exclusive vehicles on the chosen road segment using the correlation between the correlated road segments and the chosen road segment;

determine, for each of the correlated road segments, improvement that is achieved in error in estimating average travel time by using data corresponding to the estimated time taken to travel by each of the exclusive vehicles on the chosen road segment;

sort the correlated road segments based on improvement achieved in error in estimating average travel time; and determine reduction in error in estimating the average time taken to travel through the chosen road segment by using the time taken by exclusive vehicles, by considering correlated road segments in decreasing order of reduction in error, till one of the correlated road segments does not reduce error in estimate compared to the reduction in error by previous correlated road segment which provided reduction in error, wherein the correlated road segments which provided reduction in error in estimate are considered as preferred road segments wherein the processor is configured to estimate the time taken to travel by each of the exclusive vehicles on the chosen road segment using the correlation between the correlated road segments and the chosen road segment, using the equation:

$$Y(j)^1=f(X(j)),1\leq j\leq N \text{ wherein}$$

N is the number of exclusive vehicles corresponding to one of the correlated road segments;

X(j) is the time taken to travel by the $J^{th}$ exclusive vehicle through the one of the correlated road segments, $Y(j)^1$ is the estimated time taken to travel through the chosen road segment by each of the $J^{th}$ exclusive vehicles, and f is a function.

5. A system for increasing accuracy in estimating an average time taken to travel through a chosen road segment, the system comprising:

a road traffic sensing system configured to collect data corresponding to one or more vehicles travelling through road segments, thereby enabling determination of a time taken by the one or more vehicles to travel through the road segments;

at least one data repository configured to:

store a list of one or more correlated road segments for which the time taken to travel through the correlated road segments is correlated with the time taken to travel through the chosen road segment; and store historical data corresponding to the time taken to travel through the road segments; and at least one processor configured to:

determine the time taken by the one or more vehicles to travel through the road segments using the data collected by the road traffic sensing system, corresponding to one or more vehicles travelling through road segments;

identify the one or more correlated road segments for which the time taken to travel through the correlated road segments is correlated with the time taken to travel through the chosen road segment;

identify one or more preferred road segments among the correlated road segments that increases the accuracy in determining average time taken to travel through the chosen road segment; and determine the average time taken to travel through the chosen road segment using data corresponding to the time taken to travel through the preferred road segments and using data corresponding to the time taken to travel through the chosen road segment, characterized in that the processor is configured to:

identify the correlated road segments which comprise exclusive vehicles for which time taken to travel is known for the correlated road segments and not known for the chosen road segment;

estimate time taken to travel by each of the exclusive vehicles on the chosen road segment using the correlation between the correlated road segments and the chosen road segment;

determine, for each of the correlated road segments, improvement that is achieved in error in estimating average travel time by using data corresponding to the estimated time taken to travel by each of the exclusive vehicles on the chosen road segment;

sort the correlated road segments based on improvement achieved in error in estimating average travel time; and determine reduction in error in estimating the average time taken to travel through the chosen road segment by using the time taken by exclusive vehicles, by considering correlated road segments in decreasing order of reduction in error, till one of the correlated road segments does not reduce error in estimate compared to the reduction in error by previous correlated road segment which provided reduction in error, wherein the correlated road segments which provided reduction in error in estimate are considered as preferred road segments, wherein the processor is configured to determine the statistics related to the time taken to travel the chosen road segment by estimating the average time taken to travel through the chosen road segment using the equation:

$$\mu^1 = \left(\sum_{i=1}^{M} Y(i) + \sum_{j=1}^{N} Y(j)^1\right) \Big/ (M + N)$$

wherein $\mu^1$ is an estimate of the average travel time to travel through the chosen road segment, M is the number of vehicles for which the time taken to travel through the chosen road segment is available, N is the exclusive number of vehicles corresponding to the preferred road segment, Y(i) is the time taken to travel through the chosen road segment by each of the M vehicles, and $Y(j)^1$ is the time taken to travel through the chosen road segment by each of the N exclusive vehicles, estimated using the correlation between the preferred road segment and the chosen road segment.

* * * * *